United States Patent [19]

White

[11] Patent Number: 4,882,908

[45] Date of Patent: Nov. 28, 1989

[54] DEMAND DEFROST CONTROL METHOD AND APPARATUS

[75] Inventor: Lee A. White, Keller, Tex.

[73] Assignee: Ranco Incorporated, Dublin, Ohio

[21] Appl. No.: 74,907

[22] Filed: Jul. 17, 1987

[51] Int. Cl.[4] ..... F25D 21/06

[52] U.S. Cl. ..... 62/155; 62/156; 62/234; 165/17; 165/29

[58] Field of Search ..... 165/12, 17, 29; 62/155, 62/156, 234

[56] References Cited

U.S. PATENT DOCUMENTS

| | | | |
|---|---|---|---|
| 3,992,895 | 11/1976 | Kramer . | |
| 4,209,994 | 7/1980 | Mueller et al. | 62/234 |
| 4,246,956 | 1/1981 | Drucker . | |
| 4,299,095 | 11/1981 | Cassarino . | |
| 4,302,947 | 12/1981 | Mueller et al. | 62/155 |
| 4,327,557 | 5/1982 | Clarke et al. . | |
| 4,328,680 | 5/1982 | Stamp, Jr. et al. | 62/155 |
| 4,346,755 | 8/1982 | Alley et al. . | |
| 4,347,709 | 9/1982 | Wu et al. . | |
| 4,389,851 | 6/1983 | Chrostowski et al. . | |
| 4,406,133 | 9/1983 | Saunders et al. | 62/155 |
| 4,417,452 | 11/1983 | Ruminsky et al. | 62/155 |
| 4,481,786 | 11/1984 | Bashark . | |
| 4,563,877 | 1/1986 | Harnish | 62/156 |
| 4,590,771 | 5/1986 | Shaffer et al. | 62/156 |
| 4,662,184 | 5/1987 | Pohl et al. | 62/234 |

FOREIGN PATENT DOCUMENTS

| | | | |
|---|---|---|---|
| 3333907 | 4/1985 | Fed. Rep. of Germany | 165/17 |

*Primary Examiner*—John Ford

*Attorney, Agent, or Firm*—Watts, Hoffmann, Fisher & Heinke

[57] ABSTRACT

A demand defrost controller for a heat pump. The controller compares the temperature of an outdoor heat exchange coil with an enable temperature. A timer is activated when the coil temperature is less than the enable temperature. When the timer senses the compressor has run for a predetermined time the controller checks outdoor and coil temperatures to determine if a defrost cycle of the heat pump should be conducted. A defrost cycle is achieved by reversing refrigerant flow in the heat pump system for a predetermined period or until the outdoor heat exchange coil has been heated to a termination temperature.

22 Claims, 5 Drawing Sheets

DEMAND DEFROST CONTROL METHOD AND APPARATUS

TECHNICAL FIELD

The present invention relates to a control system for periodically defrosting a heat pump. When a heat pump heats a building interior, refrigerant passing through an outside heat exchanger gathers heat from outside the building, and delivers that heat to a heat exchanger inside the building. The outdoor heat exchanger typically includes a tubular coil of highly conductive metal. In the heating mode, an expansion valve delivers refrigerant to the outside heat exchanger coil where the refrigerant is heated and expands as it is vaporized. As the outside temperature approaches freezing, frost or ice can form on the outside heat exchange coil. This reduces the heat pump's efficiency and requires periodic defrosting of the outside coil. One defrost method is to reverse refrigerant flow and pump hot refrigerant from a heat pump compressor through the outside coil to thaw the ice on the coil's outside surface.

BACKGROUND ART

Different prior art procedures for detecting and controlling the formation of frost or ice on a heat pump outdoor heat exchange coil have been performed with varying degrees of success. These procedures include cyclical deicing, sensing air pressure drop across the outdoor coil, sensing temperature differences between the air and the outdoor coil, photo-optical responses from the frost (reflectivity), capacitance change due to the frost build up as well as tactile change due to ice formation on the coil. While some of these methods directly sense the formation of frost or ice, others use secondary effects, such as air pressure drop or thermodynamic and heat transfer changes in the system for initiation and/or termination of a deicing cycle.

One prior art proposal for defrosting makes use of a power factor change of an outdoor fan motor as ice builds up on the outdoor coil. The ice impedes air flow and changes the loading on the fan motor. This system is dependent on motor selection for the fan.

Photo-optical systems have been used which are positioned to view heat exchange fins or tubes on outdoor heat exchange coils and detect the presence of ice by observing changes in reflectivity of a light source. The ability to detect hoar frost and/or glare ice and differentiate the thickness of the ice build-up have been problems for these systems.

Measuring the capacitance of the frost has been tried with minimal success, due to the variability of ice, sensitivity of the signal, and critical placement of metal plates between which the frost build up occurs.

Fluidic sensors use "Coanda principles", in which air is passed thru one leg of a flow path and diverted to a second leg when a blockage signal is received. These sensors experience problems associated with dust and dirt clogging the filters protecting the small passages used in the fluidic sensor.

Still other methods employ tactile means of detecting the presence of ice, or employ the freezing effects of ice to increase friction and loading on a movable lever mechanism. These systems can only be employed on certain coil designs and adjustability has been a problem.

Other systems use electromechanically-operated timing devices to start a defrost cycle. They either reverse the refrigerant flow through the outdoor coil, turn on heaters, or blow hot gas over the coil.

These timing systems are simple and reliable. They do not, however, defrost "on demand" and therefore utilize energy for defrosting when there may not be a need to deice. Since it has been shown that a light hoar frost may even improve the effectiveness of some heat transfer surfaces the timed defrost systems appear to be undesirable.

Use of temperature responsive devices in combination with a clock-operated timer makes the defrosting "permissive". One example of this type of process is to initiate a defrost cycle only when outdoor temperatures fall below 32° F.

Electromechanical timing devices can generally also be programmed for both frequency and duration of the deice cycle. A degree of selectability is desirable to accommodate both variations in climate and idiosyncracies of individual heat pumps.

Integration of temperature responsive elements with a clock driven mechanism offers both cost effectiveness and ease of installation and servicing of the devices. These systems, when properly programmed, will perform reasonably well under most climatic conditions and offer energy savings over the inflexible cyclical defrost procedures.

Defrost systems capable of sensing two temperatures (the outdoor ambient and the outdoor coil temperature) can provide a signal when the insulating effect of frost on the coil causes the air and outdoor coil surface temperature difference to increase to a predetermined value. Such systems provide reasonable performance when properly installed and adjusted. They provide a form of "demand" defrost which is more energy conserving than cyclic heat pump defrost controls.

The effectiveness of defrost systems using the temperature difference between outdoor air and the outdoor heat exchange coil is decreased at low temperatures. At low temperatures the heat transfer capacity of the heat pump is decreased and a fully frosted heat exchange coil doesn't deviate as greatly from outdoor air temperature. To activate defrosting at low temperatures, the threshold temperature difference between coil and air temperature must be smaller. Furthermore, the temperature difference between an unfrosted coil and a fully frosted coil is reduced markedly from differentials encountered at higher outdoor air temperatures. This can lead to false defrosting if the coil temperature fluctuates for reasons other than a frosted coil.

Many heat pump expansion valves meter refrigerant to the outdoor coil depending on the heating demands sensed inside the building. These valves commonly include an expansion valve member driven between fully opened and closed positions by an electric motor and drive train which, in turn, are operated in response to sensed conditions. When the expansion valve first opens the valve member can oscillate as the valve drive and condition sensing devices seek a stable, appropriate setting. This "hunting" behaviour of the valve member causes the outdoor heat exchange coil temperature to oscillate. If the oscillatory variations in coil temperature are large enough, the difference between sensed outdoor air temperature and sensed coil temperature become sufficiently great to indicate a defrost is necessary. This is caused by a temporarily unstable expansion valve and not by a frosted outdoor coil.

Expansion valve instability can cause the coil temperature to oscillate by more than 5 degrees Fahrenheit. One solution to this temporary instability problem has been to increase the temperature differential threshold level required to begin defrosting the coil so that these fluctuations will not initiate a defrost. This solution has made the systems particularly insensitive to needs to defrost at low outdoor temperatures and, in addition, when the system refrigerant charge becomes low the system will not be defrosted.

DISCLOSURE OF THE INVENTION

The present invention provides a new and improved method and apparatus for defrosting a heat pump wherein the defrosting cycle is initiated by sensing the difference between outdoor air and heat exchanger temperature, comparing that sensed temperature difference with a value determined as a function of sensed outdoor air temperature, and initiating a defrost if the sensed temperature difference bears a predetermined relationship to the value.

In accordance with a preferred embodiment of the invention, a programmable controller monitors the temperature of the outdoor heat exchanger as well as outdoor air temperature. This information and use of a number of parameters, which are either factory programmed or set by the user, to establish a calculated comparison value determines whether a defrost cycle should be initiated.

An important feature of the invention resides in the provision of an outdoor air temperature responsive timed defrost control which operates in concert with the differential temperature responsive defrost control. The timed defrost control provides a variable "lockout" time during which defrosting can not be initiated. The lockout time is an accumulation of the time the system compressor has run. The lockout time required for defrosting increases in duration as outdoor air temperature is reduced. The differential temperature responsive defrost control is prevented from initiating a defrost cycle until a requisite lockout time has been accumulated.

The prior art problem of sensing temperature differences between the air and the outdoor heat exchanger at low outdoor air temperatures is thus addressed by the timed defrost control. The heat exchanger is defrosted after the heat pump compressor has run for a predetermined lockout time which, like the sensed temperature difference criteria is varied as a function of outdoor temperature. Since the lockout time is increased at low outdoor temperatures defrosting caused by false heat exchanger temperature sensing is prevented, at least for the predetermined lockout time. At higher outdoor air temperatures the lockout time is less and the differential temperature control predominates in determining whether the outdoor heat exchanger needs to be defrosted.

Another important feature of the invention resides in operation of a heat pump system so that initiation of a defrost cycle is precluded so long as the outdoor heat exchanger temperature is too great to justify defrosting. In the preferred embodiment if the outdoor heat exchanger is warmer than a predetermined "enable" temperature, there is no danger that the heat exchanger will frost over and therefore no defrost cycle is necessary. When the outdoor heat exchanger temperature drops below the enable temperature, however, the possibility that the heat exchanger must be defrosted is examined. This enable temperature is one of the parameters that can be factory adjusted to control the defrost cycle. Other parameters define the lockout time and temperature difference defrost criteria.

Practice of the invention results in three outdoor air temperature defrost control zones. At relatively high outdoor air temperatures the lockout times are short and the temperature difference between the outdoor air and the outdoor heat exchanger becomes the dominant defrost control. At low outdoor air temperatures the temperature differential needed to enable defrost is low so that the dominant defrost determining factor is the compressor lockout time. Thus, at low temperatures the defrost control is principally a timed function.

At intermediate outdoor air temperatures either the timed defrost control or the differential temperature defrost control can predominate in controlling the defrost cycle. After the compressor has run for a period approaching the lockout time, an outdoor heat exchanger may or may not have frosted over to cause the sensed temperature difference to enable initiation of a defrost cycle.

Use of a programmable controller to monitor the status of the outdoor heat exchanger and control a defrost cycling of the heat pump adds flexibility to the heat pump system. Different sets of parameters can be programmed into the controller to accommodate different heat pumps and their operation. By way of example, the enable temperature can be changed for different heat pump systems since a heat exchanger temperature monitoring sensor is located at different locations for different heat pumps. Use of a programmable controller also allows the lockout time and temperature difference balance to be adjusted differently for different heat pumps as well as different user needs. The temperature difference balance is adjusted by the selection of several constants that define a defrost control threshold which is examined once the lockout time has expired.

The preferred programmable controller is a microprocessor executing an operating system and control program that responds automatically to sensed conditions. One interrupt on the microprocessor is coupled to a test input to allow the user to conduct a test of the defrost cycle. Whenever this interrupt is activated, the microprocessor enters a defrost cycle to allow the defrost cycle to be monitored and evaluated.

Internal timers are driven by a second microprocessor interrupt coupled to an a.c. signal. These timers perform the lockout delay and other timing dependent functions.

An automatic defrost cycle option is provided to initiate a defrost after a certain amount of compressor run time even through the temperature criteria for defrosting have not been satisfied. When the heat pump is in a heating mode, flow reversal of refrigerant through the system at periodic intervals (every 6 hours of compressor run time, for example) is recommended by many heat pump manufacturers to recirculate lubricating oil and thereby increase the operating life of the heat pump. This flow reversal also cleans the inner surface of the outdoor heat exchanger and thereby increases heat transfer efficiency.

From the above it is appreciated that one object of the invention is an efficient and flexible demand defrost control that adjusts heat pump defrosting based upon sensed outdoor air and heat exchanger temperatures. This and other objects, advantages, and features of the invention will become better understood by reviewing the accompanying detailed description of a preferred embodiment of the invention which is described in conjunction with the accompanying drawings.

BEST MODE FOR CARRYING OUT THE INVENTION

Figure 1:
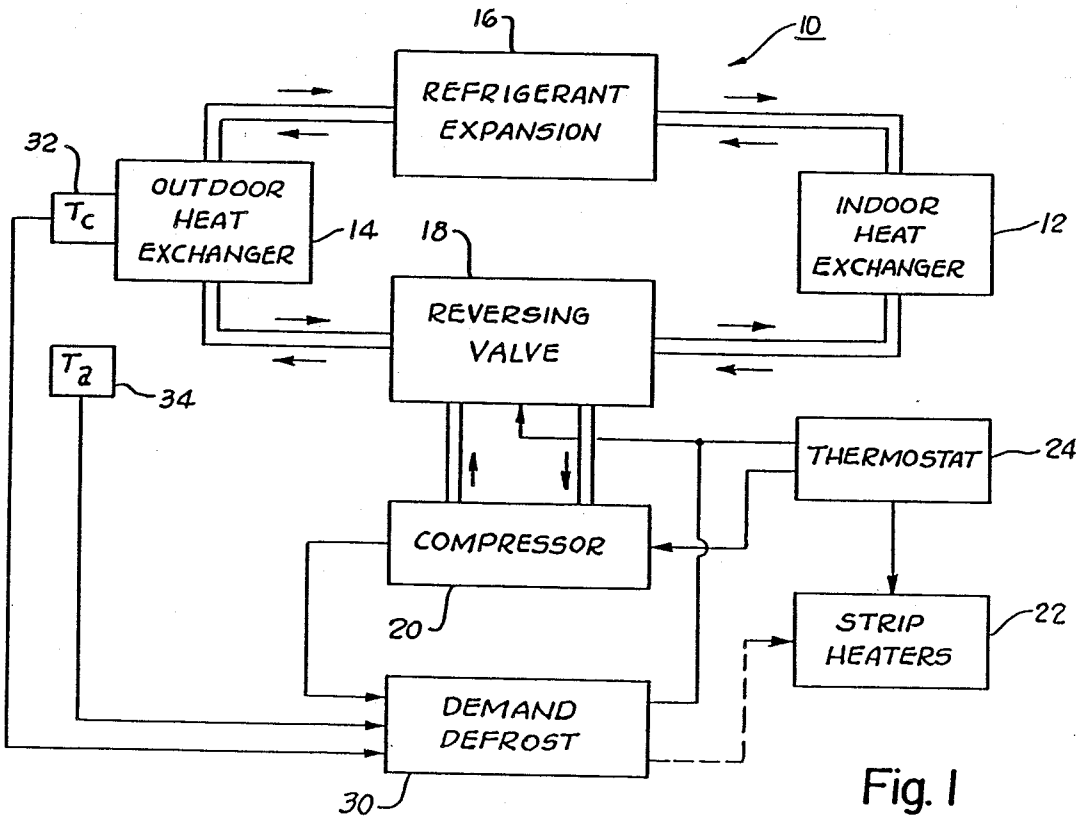
FIG. 1 is a diagrammatic representation of a heat pump system.

Turning now to the drawings, FIG. 1 illustrates a heat pump unit 10 for heating or cooling the inside of a building. The heat pump system 10 includes an indoor heat exchanger 12, an outdoor heat exchanger 14, and an expansion valve 16 coupled between the heat exchangers. Refrigerant is circulated through the system by a refrigerant compressor 20 with the refrigerant flow direction controlled by a flow reversing valve 18. The heat pump system 10 also includes electric resistance heaters 22 (called strip heaters) which are energized to heat the building whenever the heat pump system is not effective. The compressor 20 and strip heaters 22 are cycled on and off in response to control signals from a thermostat control unit 24. The unit 24 has a sensor responsive to indoor air temperature for producing an error signal having a value which depends upon the difference between sensed air temperature and a preselected set point temperature.

In the preferred embodiment of the invention the thermostat unit 24 includes a manually actuated "change over" switch (not illustrated). The change over switch is operated to a "cooling" position to position the reversing valve 18 so that the heat pump system cools the indoor air in response to cooling control signals from the thermostat 24. When the change over switch is in its "heating" position the valve 18 is positioned to direct refrigerant flow in the system for heating the indoor air and operation of the strip heaters is enabled. The heat pump and the strip heaters are operated under control of the thermostat unit 24 to heat the indoor air according to the sensed indoor air temperature.

The process of heating and cooling by a heat pump system is well known and will only be briefly summarized. In either the heating or cooling mode of operation, the compressor 20 receives gaseous refrigerant that has absorbed heat from the environment of one heat exchanger. The gaseous refrigerant is compressed by the compressor and discharged, at high pressure and relatively high temperature, to the other heat exchanger. Heat is transferred from the high pressure refrigerant to the environment of the other heat exchanger and the refrigerant condenses in the heat exchanger. The condensed refrigerant passes through the expansion valve 16 into the first heat exchanger where the refrigerant gains heat, is evaporated and returns to the compressor intake.

Typical heat pump units of the sort referred to here are constructed using heat exchangers formed by tubular coils of highly conductive metal through which the refrigerant flows. Ambient air is directed across the coils to produce conductive heat transfer. The heat exchangers are thus referred to as coils, although they could take other forms if desirable.

When the heat pump 10 operates as a air-conditioning unit the valve 18 is positioned to direct refrigerant flow so that the indoor coil 12 absorbs heat from the indoor air and the coil 14 gives off heat to the outdoor air. The thermostat 24 energizes the compressor 20 in response to sensed indoor air temperature above the thermostat setting and terminates compressor operation when the sensed indoor air temperature reaches the set point temperature.

When the heat pump 10 is operating as a heating unit, refrigerant is discharged from the compressor through the valve 18 to the indoor coil 12. The compressed gaseous refrigerant condenses in the coil 12 giving up heat to the indoor air. Fans (not shown) blow indoor air across the coil 12 and facilitate heat transfer from the coil to the air.

As the refrigerant gives up its heat content it condenses and passes through the expansion valve 16. The low pressure liquid refrigerant expands as it passes into the outdoor coil 14. The refrigerant in the outdoor heat exchange coil absorbs heat from the outdoor air and evaporates. The gaseous refrigerant then passes through the valve 18 back to the compressor intake.

The outdoor coil 14 is an energy absorber since the atmospheric air heats (and vaporizes) the refrigerant passing through the coil 14. Since the refrigerant in the outdoor coil is at a lower temperature than the atmospheric air atmospheric moisture tends to condense onto the outdoor coil. When the coil temperature is at or below freezing temperature the outdoor coil accumulates frost or ice over its outside surface. The accumulation of frost or ice impedes heat transfer from atmospheric air into the refrigerant thus reducing the effectiveness of the heat pump system.

According to the present invention conditions leading to the need for defrosting the outdoor coil are monitored so that the outdoor coil can be defrosted periodically when needed. The outdoor heat exchange coil 14 is deiced or defrosted by reversing the flow of refrigerant through the heat pump 10 for a relatively short period of time so that hot refrigerant from the compressor is directed by the valve 18 to the outdoor coil 14. The flow of hot gaseous refrigerant heats the coil 14 and melts accumulated frost or ice on the coil's outside surface.

When the coil is defrosted, the valve 18 reverses the system refrigerant flow direction again so that the heat pump resumes its heating function with renewed effectiveness.

The defrosting cycle of the heat pump system 10 is initiated and terminated by a demand defrost controller 30 in response to sensed conditions indicative of the need for performance of a defrosting cycle.

The controller 30 provides three interactive defrost cycle controls. The preferred controller 30 only enables initiation of a defrost cycle when: (1) the outdoor coil temperature is low enough to warrant defrosting; and (2) when a timed defrost control enables defrosting; and (3) when a differential temperature responsive demand defrost control enables defrosting. It has been found that outdoor coils do not accumulate frost or ice when the measured coil temperatures exceed certain levels (which, in certain cases, may be below freezing). By definition, defrosting is not necessary at such coil temperatures. The controller 30 operates to enable a defrosting cycle only when the sensed coil temperature is below a predetermined value.

The controller 30 also functions as a timed defrost control by accumulating the amount of time the compressor 20 runs and enabling a defrost cycle to be initiated when sufficient compressor run time is accumulated. The preferred controller 30 operates to vary the amount of the accumulated run time necessary to enable a defrost cycle depending on sensed outdoor air temperatures.

The differential temperature demand defrost control function is provided by the controller 30 so that, when the first two defrosting criteria are satisfied, the defrost cycle is only initiated when outdoor air and coil temperatures differ sufficiently to indicate a frosting condition. In this regard the controller 30 compares the sensed outdoor coil and outdoor air temperature differential and compares that differential with a value which varies as a function of outdoor air temperature. When the measured differential and the calculated value bear a predetermined relationship the controller 30 initiates a defrost cycle. The outdoor coil and outdoor air temperatures are monitored by temperature sensors 32, 34, respectively, which generate control inputs to the controller 30. An additional input to the controller 30 is generated when the compressor 20 is running so that the timed defrost function control can be realized. These three controller inputs provide sufficient information for the controller 30 to determine when to defrost the outside coil 14.

Demand Defrost Function

Figure 4:
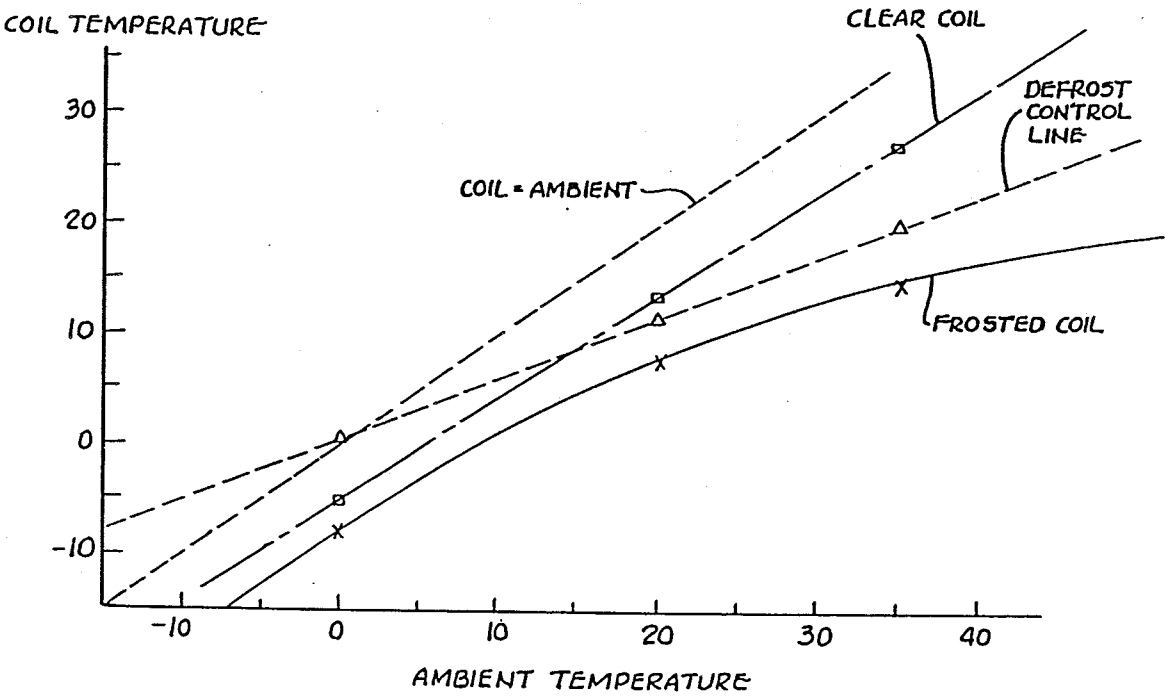
FIG. 4 is a graph showing outdoor air and outdoor heat exchanger temperatures for a clear heat exchanger and for a frosted heat exchanger.

FIG. 4 is a graph showing sensed outdoor coil temperatures plotted against outdoor air (or "ambient") temperatures for a heat pump unit operating in its heating mode. The graph of FIG. 4 shows plots for a clear (i.e., unfrosted) heat exchange coil and for a "frosted" heat exchange coil. These plots are based on identical heat pump units operating under identical circumstances. The data show that the temperature difference between the heat exchanger coil 14 and outdoor air is smaller for a clear coil than for a coil covered with ice. At 30° Fahrenheit, for example, the temperature difference between atmospheric air and a coil covered with ice is approximately 20° F. At lower outdoor air temperatures (5–10° F.) the temperature difference between a coil covered with ice and outdoor air decreases to about 5–10° F. The disclosed demand defrost control operates primarily in response to sensed temperature difference at relatively high outdoor air temperatures and primarily on the timed defrost basis at low outdoor air temperatures where the small temperature differences between the coil and air may be difficult to use as an accurate defrost indicator.

Three outdoor air temperature based zones of control are generally defined. At relatively high outdoor air temperatures if after a relatively short compressor run period the sensed coil and air temperatures are below the line designated Defrost Control Line in FIG. 4 the heat exchange coil 14 is defrosted. This Defrost Control Line is derived from a control equation relating coil and air temperature differences to air temperature. The slope and offset of the Defrost Control Line are determined by three constants which are set to customer specifications. In this first control zone the temperature differences are relatively large and can be accurately sensed.

At low temperatures (5–10° F.) the sensed coil and air temperatures fall below the FIG. 4 Defrost Control Line. Even the clear coil temperatures fall below this line. Thus, at low temperatures, when a compressor lockout time has elapsed, a defrost will be initiated since the temperature difference criteria will be satisfied. To avoid too frequent defrosting the compressor lockout time is increased at low temperatures.

At intermediate temperatures (15–20° F.) both elapsed compressor run time and temperature difference contribute to the defrost control decision. In some instances the coil will be frosted (as defined by the Defrost Control Line) when the elapsed compressor run time condition is met. In other instances the lockout time will expire and the coil is not yet frosted so the controller 30 waits for the sensed temperatures to fall below the Defrost Control Line. Since the Defrost Control Line determines these zones of control and since the slope and offset of this line are set by the adjustable constants programmed into the controller 30 the zones are also adjustable depending on customer needs.

The Demand Defrost Controller 30

Figure 2A:
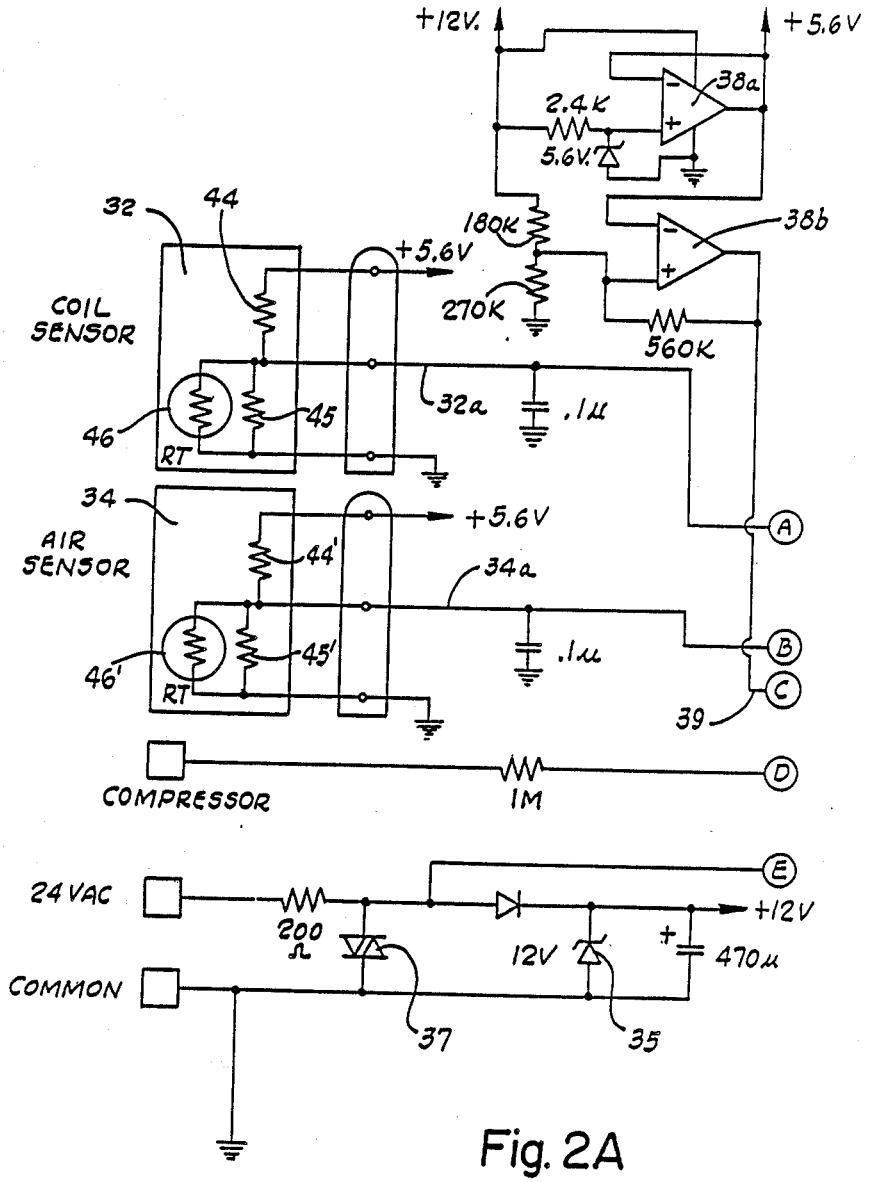
FIGS. 2A and 2B are detailed schematics of a heat pump demand defrost controller.
Figure 2B:
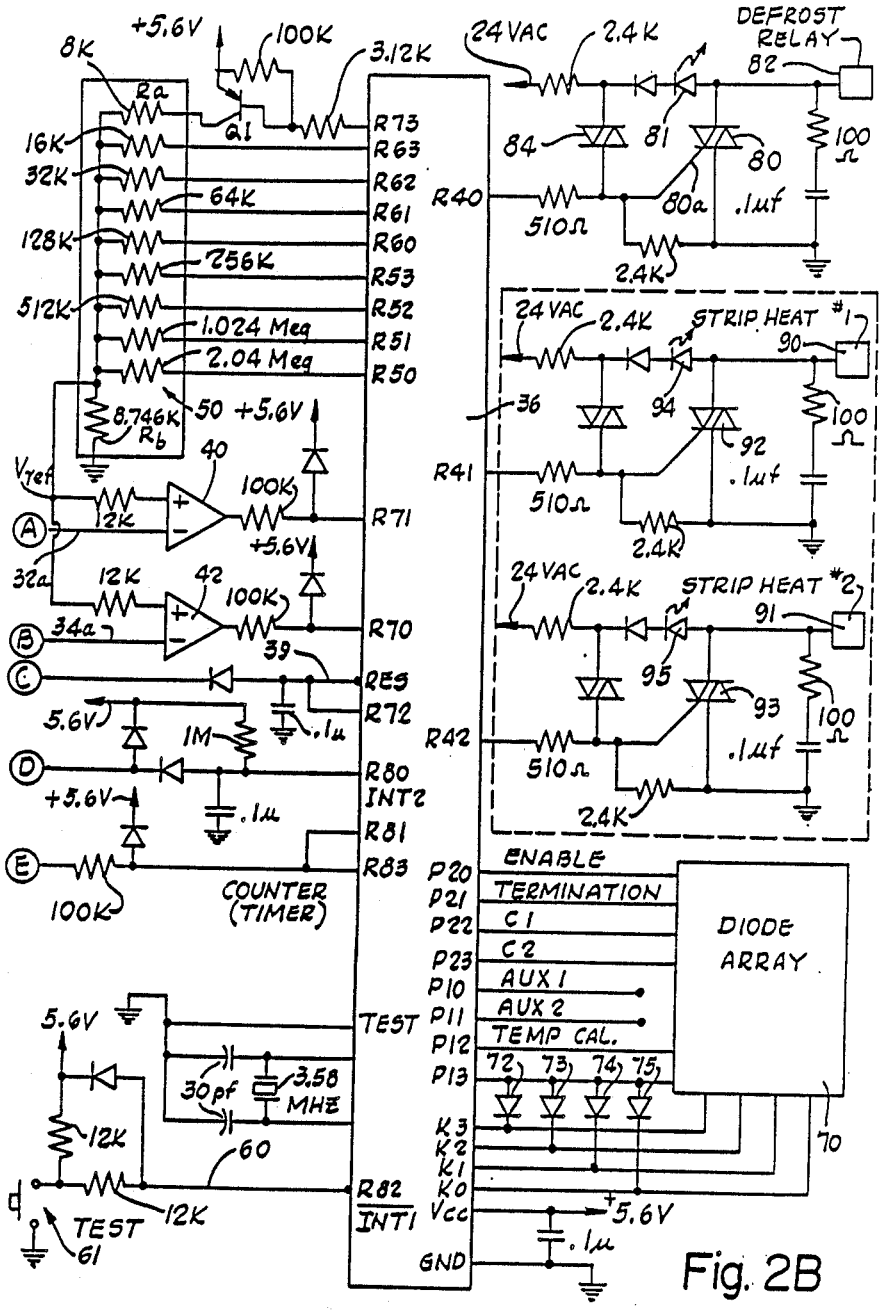

FIGS. 2A and 2B depict a detailed schematic of the demand defrost controller 30. The controller 30 includes a model 47C210 microprocessor 36 commercially available from Toshiba. This microprocessor 36 operates at a clock frequency of 3.58 megahertz and has an internal memory for storing an operating system as well as control parameters and therefore needs no support peripheral devices in the way of RAM and ROM circuits.

Power is applied to the control 30 by a 24 volt 60 hertz a.c. input signal (FIG. 2A that energizes a precision zener diode 35 which in combination with a resistor and capacitor produce a filtered, regulated 12 volt d.c. signal. A diac 37 in parallel with the zener diode 35 limits voltage reaching the zener diode 37 to less than 60 volts. Two operational amplifiers **38*a*, 38*b* are energized by this 12 volt signal. A first operational amplifier 38*a* provides a regulated 5.6 volt d.c. signal to energize the microprocessor 36. The second operational amplifier 38*b* activates a reset input 39 to the microprocessor when the control 30 is initially energized. The receipt of a signal at the reset input 39 causes the microprocessor 36** to begin execution of its operating system.

Temperature Sensors

The control 30 monitors heat exchanger coil and ambient temperatures at periodic intervals. The two temperature sensors 32, 34 (FIGS. 1 and 2A) are coupled to two comparator amplifiers 40, 42 (FIG. 2B) having outputs connected to the microprocessor 36. The outdoor coil sensor 32 monitors the temperature of the outdoor coil 14 and is physically attached to that coil. The sensor 34 monitors outdoor air temperature. The sensor 32 includes three resistors 44, 45, 46. Two resistors 44, 45 have fixed resistances and the third resistor 46 is a precision thermistor whose resistance varies with temperature. The combination of the three resistors 44, 45, 46 forms a potentiometer whose voltage varies with temperature. As the temperature of the thermistor resistor 46 rises, its resistance lowers as does the parallel combination of the thermistor resistor 46 and the resistor 45. The voltage on an output **32*a* from the sensor 32 is directly related to the temperature of the heat exchange coil 14**. In a similar way three resistors 44', 45', 46' define the sensor 34 for measuring air temperature by providing a voltage at an output 34a.

The comparator amplifier 40 (FIG. 2B) has two inputs, one of which is coupled to the output 32a from the sensor 32. A second input to the comparator 40 is generated by a voltage divider 50 which includes an array of resistors which are selectively coupled in parallel arrangements under control of the microprocessor 36.

When a pin designated R73 on the microprocessor 36 goes low, a transister Q1 is energized and two resistors Ra, Rb coupled to a collector junction of the transistor Q1 define a reference voltage Vref at a noninverting (+) input to the comparator 40. The status of eight additional microprocessor pins R50, R51, R52, R53, R60, R61, R62, R63 are turned on or off to vary the reference voltage Vref. These pins can function as a current source due to a pull-up resistor configuration integral within the microprocessor 36. By selective energization of these pins, the microprocessor can select one of 256 ($2^8$) reference voltages for the voltage divider 50.

The microprocessor monitors (at pin R71) the output status of this comparator 40 as the reference voltage is adjusted. A change in state is correlated with a resistor configuration used to generate the reference input to the comparator 40. In this way, the output potential of the sensor 32 is sensed and converted via a look-up table to a temperature. The combination of the voltage divider 50 and comparator 40 defines an analog-to-digital (A/D) converter that converts the analog output from the sensor 32 to a digital value sensed at the comparator output.

In a similar fashion, the reference voltage from the voltage divider 50 is varied by the microprocessor 36 as it monitors the output of the comparator 42 coupled to the sensor 34 for monitoring ambient temperature in close proximity to the outdoor heat exchange coil 14.

To help avoid an erroneous defrost cycle initiation due to coil temperature fluctuations (as the expansion valve 16 hunts for a proper setting for example), the coil temperature $T_c$ sensed by the sensor 32 is averaged with seven previous readings and stored in memory. This average reading is used in testing to determine if defrosting is needed. When the compressor 20 is not running, no coil temperature readings are sensed but previously sensed average coil temperatures are stored. When the compressor 20 next cycles on and the coil temperature is again sensed it is averaged into the stored temperature so that first reading (which tends to be inaccurate if the system has not stabilized at compressor start-up) is low weighted.

Timing and Interrupts

To control the frequency at which temperature outputs from the sensors are obtained as well as to time compressor run times, the microprocessor 36 implements an internal timer function. An input pin R83 is coupled to the same 24 volt 60 hertz alternating current signal that is rectified and filtered to produce the 12 volt d.c. energizing signal. Sixty times a second the voltage at this input goes low and the microprocessor 36 updates an internal timer. The microprocessor monitors the status of this internal timer and updates the temperatures at the sensors 32, 34 at regular intervals.

A signal at microprocessor pin R80 from the compressor 20 activates one microprocessor interrupt. When the compressor 20 is not operating, the microprocessor 36 is in an idle state awaiting this interrupt and does not monitor the temperature at the sensors 32, 34. After receipt of this interrupt the microprocessor also begins to accumulate compressor run time.

A second interrupt at a microprocessor pin R82 is coupled to a test input 60 that can be selectively grounded. When a test switch 61 is manually closed the microprocessor 36 initiates a defrost cycle to facilitate diagnostic testing of the heat pump system.

Demand Defrost Parameters

During demand defrost monitoring the microprocessor 36 utilizes numeric constants that are either stored internally in the microprocessor or accessed from an external diode array 70 (FIG. 2B) coupled to the microprocessor. These numeric constants are discussed in more detail below. Briefly, a defrost enable temperature, defrost termination temperature, and three constants C1, C2 and C3 for evaluating the temperature difference between the coil and ambient are used to initiate and terminate the defrost cycle. On power-up of the microprocessor it is assumed that the diode array 70 is preprogrammed to contain this information.

By energizing four output pins P20, P21, P22, P23 connected to the diode array 70, and monitoring the status of four diode array outputs at pins K0–K3, the microprocessor 36 determines the value of four constants programmed in the diode array 70. If an invalid diode array code is sensed the microprocessor 36 checks to determine what combination of jumper diodes 72–75 have been coupled from pin P13 to the four microprocessor inputs K0–K3. In the configuration depicted in FIG. 2B four diodes are in place. This configuration represents one of sixteen possible sets of constants stored in a microprocessor read only memory (see Table II below).

Defrost and Optional Strip Heater Outputs

To initiate a defrost the microprocessor 36 energizes output pin R40 which, in turn, causes energization of a defrost relay coil 82. The coil 82 is energized to turn on the compressor 20 and activate the reversing valve 18 to route hot refrigerant through the outdoor heat exchange coil 14. In the illustrated embodiment the output pin R40 is coupled to a triac 80 having a gate 80a. When turned on by the microprocessor, the triac 80 energizes the defrost relay coil 82 and an associated light emitting diode 81 to indicate a defrost cycle is in progress. A diac 84 prevents transients from damaging the triac 80 by limiting the voltage across the triac to approximately 60 volts.

Microprocessor output pins R41, R42 are optionally employed to activate two strip heater relay coils 90, 91 via associated triacs 92, 93. This optional circuitry is illustrated within broken lines in FIG. 2B. Light emitting diodes 94, 95 indicate when the strip heaters are turned on by the microprocessor 36. The strip heaters are turned on simultaneously or in staged fashion when the coil 14 is defrosted and the outdoor air temperature determined by the sensor 34 is below a strip heat initiation temperature or temperatures.

The Microprocessor Operatinqg System

On receipt of a reset signal the microprocessor 36 initializes 110 (FIG. 3) the numeric constants used by the microprocessor operating system while conducting its demand defrost function. This initialization is accomplished by determining the status of the diode array 70 or the configuration of the diodes 72–75 to determine which set of constants stored in microprocessor ROM memory should be used. The constants are transferred to a RAM area of the microprocessor and accessed as needed during the execution of the microprocessor operating system.

Status indicators or flags are set 112 at a next stage of the demand defrost procedure. In addition, timers are initialized and the microprocessor interrupts are enabled. The microprocessor then enters an inactive state 114 until it receives an interrupt at input pin R80 indicating the heat pump compressor 20 is running. In the present embodiment, when the compressor is not running no temperature sensor readings are obtained. When the compressor begins to run, the microprocessor initiates a two minute wait period for the heat pump system to stabilize. This stabilization wait period is accomplished in software and is available as a manufacturing option. At the end of this two minute wait period the microprocessor 36 waits 116 for the evaporator coil temperature to drop below an enable temperature.

Figure 3:
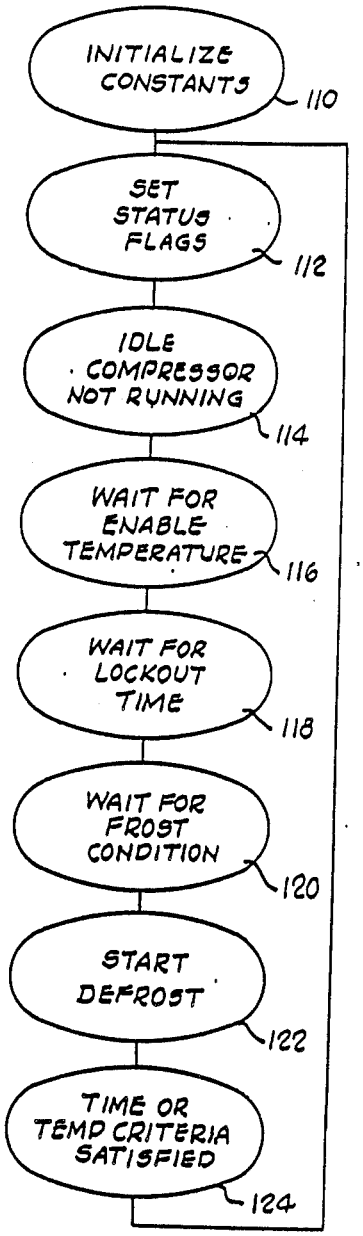
FIG. 3 is a flow chart depicting a state diagram for the demand defrost controller as the controller monitors heat pump operation.

The operation of the next four states 116, 118, 120, 122 depicted in FIG. 3 are summarize in four pseudo-code program listings. During execution of the computer code summarized in these pseudo-code listings microprocessor subroutines are executed to perform specialized functions such as monitor a sensor temperature, access a constant stored in memory, perform a comparison or calculation, etc.

Listing 1 (below) is a pseudo-code listing of a program the microprocessor executes while waiting for the outdoor heat exchanger coil temperature to fall below the enable temperature. The enable temperature is one of the sets of parameters stored in the diode array 70 and alternately stored in the microprocessor. A sensed coil temperature above the enable temperature indicates frost will not form on the coil.

While waiting for the coil temperature to fall below the enable temperature the microprocessor 36 periodically senses the coil temperature $T_c$ and the ambient temperature $T_a$. The coil temperature is sensed at regular one minute intervals and the ambient temperature is measured as often as possible. The frequency of the ambient temperature measurement varies between one and two minutes. A test is performed to determine if the sensed temperature indicates the sensors 32, 34 have malfunctioned. A sensor is defined to be malfunctioning if a scanning of the 256 possible resistance combinations provided by the resistor array 50 fails to produce a change in the outputs of the comparators 40, 42. A short or open circuit condition of the sensor will cause this to occur. If the ambient temperature sensor 34 is disconnected or electrically shorted, the microprocessor initiates a defrost cycle at regular 90 minute intervals of compressor run time rather than perform the demand defrost function. If the coil temperature sensor 32 is either disconnected or shorted, the microprocessor 36 stops transmitting defrost relay control signals.

Referring to the Listing 1 summarization, one sees that the while loop defining the microprocessor wait state 116 is exited when:

(a) the coil falls to a temperature at or below the enable temperature; or (b) a test input (interrupt 1) is received at microprocessor pin R82.

If the test input is active the microprocessor initiates a defrost immediately and if the enable condition is satisfied the microprocessor progresses to a lockout condition wait state 118.

Compressor Lockout Condition

If the outdoor coil temperature drops below the enable temperature, the microprocessor begins accumulating compressor run time (including the optional two minute wait state mentioned previously) and compares the accumulated run time with a microprocessor calculated time value that depends upon ambient temperature. This value is referred to as the "lockout compressor run time" and assures that the colder the outdoor or ambient temperature, the greater the amount of accumulated compressor run time required before a defrost cycle is initiated. Thus defrosting is not conducted at too frequent intervals during periods when heating demands are greatest and frost buildup conditions are diminished.

A pseudo-code listing for the microprocessor wait state 118 to determine when the lockout time has expired is presented below in Listing 2.

While waiting for the lockout timer to time out, it is possible that the outdoor heat exchanger coil temperature has risen above the enable temperature. If the coil temperature rises above the enable temperature, the lockout time wait state 118 is exited and the microprocessor returns to the state 116 where it waits for the coil temperature to again fall below the enable temperature. When this happens, the accumulated lockout time is maintained and the lockout timer re-started from the accumulated time the timer had reached when the expansion coil temperature exceeded the enable temperature.

If the compressor 20 stops running as the lockout time is accumulating, the accumulated lockout time is also stored. When the compressor again turns on, if the enable temperature condition is satisfied, the lockout compressor run time is again started where it left off.

The last if-then test of the Listing 2 pseudo-code refers to a defrost cycle that is performed in the event the ambient temperature sensor 34 has malfunctioned. The microprocessor 36 reaches this ambient sensor if-then test only if (1) the coil sensor is functioning, (2) the defrost test switch 61 has not been activated, (3) the coil temperature is not above the enable temperature, and (4) the lockout time has timed out.

If the ambient sensor 34 has malfunctioned the controller 30 converts to a strictly timed defrost at 90 minute intervals. Whenever the ambient sensor 34 fails the microprocessor 36 executes a subroutine that sets the lockout time to 90 minutes. Thus, whenever the sensor 34 fails, criteria 4 is adjusted to achieve a 90 minute defrost cycle time.

Table 1 below lists the compressor lockout run times for different ambient temperatures when the ambient sensor 34 is properly functioning. The contents of this table are stored in the microprocessor's ROM memory.

Test for Frost Condition

A next microprocessor wait state 120 (FIG. 3) test for a frost condition. This state is entered only if both the coil sensor 32 and ambient sensor 34 are functioning and the compressor lockout run timer has timed out. In this wait state 120 the microprocessor tests for a difference between an outdoor coil temperature and the ambient temperature. A large enough difference between these two temperatures causes the microprocessor 36 to energize the defrost relay 82 to cause outdoor heat exchanger coil defrosting. Equation 1 below summarizes the test the microprocessor 36 performs in determining whether a frost condition exists:

$$T_a - T_c = \Delta T \geqq C_1(T_a - C_3) + C_2 \quad \text{Eq. (1)}$$

When the measured difference, ΔT, of this equation is equal to or greater than the calculated value based on ambient temperature, the microprocessor initiates a defrost cycle by activating the triac 80 that closes a defrost relay contact and actuates the reversing valve 18.

At a threshold wherein the temperature difference is set equal to the right hand side of equation 1 and if $C_3$ is zero, one has an equation which after rearranging is of the form:

$$T_c = T_a(1 - C_1) - C_2 \quad \text{Eq. (2)}$$

This equation is the Defrost Control Line of FIG. 4.

Listing 3 summarizes the steps the microprocessor performs while awaiting the frost condition to occur.

If the compressor stops running or the outdoor coil temperature exceeds the enable temperature, the microprocessor will stop monitoring for the frost condition. When the compressor turns on and the coil temperature again falls below the enable temperature the microprocessor again checks to see if the frost condition is satisfied.

The 6 hour override option in Listing 3 refers to an automatic defrost conducted every 6 hours of compressor run time regardless of other defrost criteria. This option can be programmed into the microprocessor operating system.

Defrost Cycle

The defrost cycle is conducted by reversing refrigerant flow through the valve 18. The defrost cycle is conducted until either the coil temperature rises above a termination temperature (one of the numeric constants initialized at step 110 FIG. 3) or until the defrost cycle has lasted a specified time, for example, 15 minutes. The steps conducted by the microprocessor 36 during a defrost cycle are listed below in Listing 4.

If the strip heaters 22 are activated by the controller 30 and the outdoor air temperature is below a threshold value, both heaters 90, 91 are turned on to combat the cooling effects of a defrost cycle.

Once a defrost cycle is entered, the coil sensor 32 is the only temperature sensor which is monitored by the microprocessor 36 and the effects of the reversal of refrigerant through the heat pump are monitored at this sensor.

The while loop that checks the status of a termination flag monitors the output from the comparator 40 at microprocessor pin R71. A low output from the comparator 40 indicates the coil temperature is greater than the termination temperature and the defrost cycle has been successfully conducted. The termination flag is also set if the defrost cycle is conducted for 15 minutes.

At the conclusion of a defrost cycle when either the time condition or the temperature condition is satisfied, the microprocessor sets the termination flag, exits the while loop and jumps to step 112 of the FIG. 3 state diagram where the flags or status indicators are reset.

The Table 1 lockout times are stored in the microprocessor's ROM memory. The coil enable and defrost termination temperatures and numeric constants $C_1$, $C_2$, and $C_3$ of equation 1 are either programmed in the diode array 70 or stored in the microprocessor 36. One illustrative factory set-up of the diode array sets these values for these numeric constants: Enable temperature 35 degrees F., Terminaton temperature 55 degrees F., $C_1=0.1$, $C_2=12$, $C_3=0$.

Table II (below) illustrates sixteen different options stored in microprocessor ROM which are selected if the diode array 70 is not configured. Note, the constant C3 is zero for all sixteen sets of control constants. Other choices for this constant, 15° F. for example, have been successfully utilized in conducting the demand defrost control of the invention.

Demand Defrost Control Options

In the present embodiment of the system 10, the strip heaters 22 respond only to the thermostat control 24. In an alternate embodiment of the invention the demand defrost control also activates the strip heaters when a defrost cycle is initiated and the sensed outdoor temperature is below a threshold temperature.

When the strip heaters 22 are controlled by the microprocessor, however, they can be actuated simultaneously when a single strip heater initiation temperature condition is sensed. Alternately, the microprocessor can monitor ambient temperature from the sensor 34 and energize the two strip heaters based upon different threshold values so one or both strip heaters are energized as ambient temperature conditions change.

The strip heat control temperatures, if used, are input via thumb wheel selector switches connected to microprocessor pins P10, P11. Four switch contacts of a thumbwheel selector switch allow 16 different settings for this temperature. In one embodiment of the invention, the sixteen possible switch settings are used to adjust this temperature in equal increments from 20 to 30 degrees F. The microprocessor samples the status of pins P10 by energizing pin P10 (Aux 1) and monitoring the input state of pins K0–K3. If a particular switch contact is closed, the microprocessor will sense a high input at an associated one of the input ports K0–K3. In a similar manner the status of a second switch connected to pin P11 controls an initiation temperature for a second of the strip heaters 22. As an alternate method when no switch inputs are used as the strip heat initiation temperature or temperatures are stored in the microprocessor (see Table II).

A second option that is not presently implemented is to sense for an outdoor heat exchanger coil melting condition. Temperature sensing of both the coil and ambient air is suspended when the compressor is not running. Since power is being applied to the microprocessor whether the compressor is running or not, however, these temperatures could be sensed at all times. If during a compressor off period the coil temperature rises high enough, above a melting condition temperature, all status flags can be reset and in particular the compressor lockout time can be reset.

A temperature calibration option may also be added. If the resistor elements forming the sensors 32, 34 exhibit variations from their nominal resistance values a correction factor can be programmed into the diode array 70 and sensed at pin P12. In this way slightly inaccurate sensed temperatures are modified with a correction factor. This correction factor is determined after factory fabrication and testing of the sensors 32, 34 and is used to compensate minor inaccuracies in those sensors.

While one embodiment of the present invention has been described with a degree of particularity, it is the intent that the invention include all alterations and modifications from the disclosed design falling within the spirit or scope of the appended claims.

I claim:

1. A method of defrosting an outdoor heat exchanger of a compressor-condenser-evaporator type heat pump unit in accordance with sensed conditions indicative of the need to perform a defrost cycle comprising:

(a) sensing the temperature of the outdoor heat exchanger;

(b) sensing the outdoor air temperature;

(c) monitoring compressor running time until a predetermined accumulated running time that varies as a function of outdoor air temperature has elapsed;

(d) enabling defrosting of the outdoor heat exchanger when said running time has elapsed;

(e) detecting the extent of the temperature differential between the sensed outdoor heat exchanger temperature and the sensed outdoor air temperature;

(f) determining a value indicative of the frosting condition of the heat exchanger which valve varies as a function of outdoor air temperature;

(g) comparing the value with the sensed temperature differential;

(h) enabling a defrosting cycle when the sensed temperature differential and the value bear a predetermined relationship to each other; and, (i) initiating a defrost cycle only when enabled by said compressor running time elapsing and enabled by said sensed temperature differential bearing a predetermined relationship to said value.

2. The method of claim 1 wherein accumulating compressor running time is only performed when the outdoor heat exchanger temperature is below an enable temperature.

3. A compressor-condenser-evaporator type heat pump system including a defrost controlling means for governing defrosting of the outdoor refrigerant heat exchanger by initiating a defrost cycle, said defrost controlling means comprising:

(a) an outdoor atmospheric air temperature monitoring sensor;

(b) an outdoor heat exchanger temperature monitoring sensor;

(c) a time defrost system for accumulating the aggregate running time of the compressor when the sensed heat exchanger temperature is below an enable temperature and enabling initiation of an outdoor heat exchanger defrost cycle after a predetermined compressor running time has been accumulated, said time defrost system constructed to enable defrosting at accumulated compressor run times which are relatively short at atmospheric temperatures approaching a relatively high predetermined temperature and lengthen as atmospheric temperatures are reduced from said relatively high predetermined temperature;

(d) a frosting condition responsive system for detecting the differential between the outdoor air temperature and the outdoor heat exchanger temperature and comparing said differential to a value which varies according to sensed outdoor air temperature, said frosting condition responsive system enabling initiation of a defrosting cycle when the differential and the value bear a predetermined relationship, said frost condition sensing system tending to enable initiation of defrosting cycles at relatively small sensed differential temperatures when atmospheric air temperatures are substantially below said predetermined temperature with the sensed temperature differential required to initiate defrost increasing as atmospheric air temperatures increase toward said predetermined level;

(e) controller means for initiating a defrost cycle in response to said time defrost system and said frost condition sensing system both enabling a defrost cycle; and (f) said time defrost system and said frost condition responsive system coacting so that when outdoor air temperatures approach said predetermined temperature defrosting of said heat pump is initiated primarily in response to sensed temperature differential and when outdoor air temperatures are substantially below said predetermined temperature and heat pump is defrosted primarily in response to elapsed compressor run time.

4. A method of defrosting a heat pump comprising the steps of:

periodically sensing an ambient atmospheric air temperature and an outdoor heat exchanger coil temperature;

comparing the heat exchanger coil temperature with a preselected enable temperature;

enabling defrosting of the heat exchanger coil in relation to sensed temperature including, when the heat exchanger coil temperature is less than the enable temperature, accumulating compressor run time until a predetermined lockout period that varies as a function of ambient temperature has elapsed;

after the lockout period, comparing a difference between the ambient temperature and the heat exchanger coil temperature with a temperature difference value dependent on the ambient temperature; and if the temperature difference between the ambient temperature and heat exchanger coil temperature is greater than or equal to the difference value, defrosting the heat exchanger coil.

5. The method of claim 4 wherein a defrost procedure is terminated after a predetermined time.

6. The method of claim 4 wherein the accumulated compressor run time is maintained when the coil temperature is above the enable temperature and the accumulated run time is updated when the coil temperature is above the enable temperature.

7. The method of claim 4 additionally comprising a step of monitoring an ambient temperature sensor failure and in the event of such a failure defrosting the heat exchanger coil at timed periods of compressor run time if the heat exchanger coil is below the enable temperature for said timed periods.

8. The method of claim 4 wherein the heat exchanger coil temperature used in the comparing steps is determined by averaging a number of successive sensed heat exchanger coil temperatures.

9. The method of claim 4 wherein the predetermined lockout period is increased at low temperature.

10. The method of claim 4 further including accumulating elapsed time during defrosting, sensing the coil temperature as the coil is being defrosted, terminating the defrosting step in response to a sensed coil temperature above a predetermined defrost termination temperature, and terminating defrosting upon the accumulation of a predetermined defrost time interval regardless of sensed coil temperature.

11. Heat pump control apparatus for use with a heat pump system having an indoor heat exchanger, outdoor heat exchanger, and a compressor operable to create a flow of refrigerant through said indoor and outdoor heat exchangers, said heat pump control apparatus comprising:

first temperature sensor means for monitoring ambient air temperature in proximity to said outdoor heat exchanger and second temperature sensor means for monitoring the temperature of said outdoor heat exchanger;

storage means for storing a preselected adjustable defrost enable temperature of said system and one or more parameters that define an outdoor heat exchanger function related to ambient temperature;

processor means for comparing the temperature of the outdoor heat exchanger with the adjustable enable temperature and setting a status indicator if the outdoor heat exchanger temperature is less than the enable temperature;

the processor means comprising means for establishing an outdoor heat exchanger frosting function value based on said parameters and sensed ambient temperature and comparing a difference between ambient temperature and outdoor heat exchanger temperature with the outdoor heat exchanger frosting function value; and defrost means to defrost the outdoor heat exchanger;

said processor means having timing means to monitor the status indicator and activate the defrost means after the status indicator has been set for a predetermined compressor run period related to ambient temperature and the difference between ambient temperature and outdoor heat exchanger temperature bears a predetermined relationship to the outdoor heat exchanger frosting function value.

12. The control apparatus of claim 11 additionally comprising means to signal said processor means when the heat pump compressor is running to cause said processor means to begin comparing the outdoor heat exchanger temperature with the enable temperature.

13. The control apparatus of claim 11 wherein the processor means includes averaging means to average a number of successive outdoor heat exchanger temperature readings and provide an average outdoor heat exchanger temperature for comparing with the enable temperature.

14. A method of defrosting a heat pump outdoor heat exchanger comprising the steps of:

(a) defining a defrost lockout period relating a heat pump compressor run time with temperature, said lockout period increasing with decreasing ambient temperature;

(b) defining a heat exchanger frosting function relating a temperature difference between the outdoor heat exchanger and ambient temperature with sensed temperature; said frosting function providing a value decreases with decreasing ambient temperature;

(c) monitoring compressor run time and temperature difference between the heat exchanger and ambient temperature; and (d) defrosting the heat exchanger when the compressor run time exceeds the lockout period and the temperature difference bears a predetermined relationship to the frosting function value;

(e) said increasing lockout period and decreasing frosting function value causing the defrosting step to be principally controlled by the compressor run time at low temperature and by heat exchanger and ambient temperature difference at high temperature.

15. The method of claim 14 wherein monitoring compressor run time and temperature difference between the heat exchanger and ambient temperature is conducted only when the heat exchanger temperature drops below an enable temperature.

16. A method of initiating the defrosting cycle of a condenser-compressor-evaporator type heat pump unit in response to the existence of three necessary enabling conditions comprising:

(a) establishing a first defrost cycle enabling condition in response to outdoor heat exchanger temperature comprising:

(i) sensing the temperature of the outdoor heat exchanger;

(ii) monitoring the sensed heat exchanger temperature; and (iii) enabling initiation of the defrost cycle when the monitored heat exchanger temperature is at or below a predetermined level;

(b) establishing a second defrost cycle enabling condition by determining that the compressor has run an aggregate time which exceeds a predetermined defrosting cycle lockout time period which varies with outdoor air temperature comprising the steps of:

(i) establishing a defrosting cycle lockout time period during which initiation of the defrosting cycle cannot be enabled;

(ii) monitoring operation of the compressor and determining the aggregate time the compressor operates during said lockout period;

(iii) increasing and decreasing the extent of said lockout period in response to sensed decreases and increases, respectively, of the ambient air temperature occurring during the lockout period; and, (iv) enabling initiation of the defrost cycle when the aggregated compressor run time exceeds the most recently established lockout time period;

(c) establishing a third defrost cycle enabling condition in response to the indication of frost or ice on said outdoor heat exchanger comprising:

(i) sensing the outdoor atmospheric air temperature and monitoring that temperature;

(ii) determining the difference between the sensed atmospheric air temperature and the sensed outdoor heat exchanger temperature; and (iii) enabling initiation of a defrosting cycle when the sensed temperature difference bears a predetermined relationship to the sensed outdoor air temperature; and, (d) initiating said defrosting cycle when said first, second and third enabling conditions coexist.

17. The method of claim 16 wherein the second enabling step is initiated only while the outdoor heat exchanger is at or below the predetermined level.

18. A method for defrosting a heat pump comprising the steps of:

as the heat pump compressor is running periodically sensing an ambient temperature with an ambient temperature sensor and sensing an outdoor heat pump expansion coil temperature with an expansion coil temperature sensor;

comparing the expansion coil temperature with an enable temperature;

if the coil temperature is less than the enable temperature accumulating compressor run time until a predetermined compressor lockout period has elapsed;

testing to determine the operative status of the ambient temperature sensor and in the event of a failure in the ambient temperature sensor, defrosting the expansion coil once the lockout period has elapsed;

if the ambient temperature sensor is operative, subsequent to the lockout period, comparing a difference between the ambient temperature and the coil temperature with a temperature difference value dependent on the ambient temperature and if the difference between the ambient and coil temperature is greater than or equal to the difference value, defrosting the expansion coil.

19. The method of claim 18 wherein the compressor lockout period is determined on the basis of ambient temperature if the ambient temperature sensor is operative and the compressor lockout period is fixed if the ambient temperature sensor has failed.

20. Heat pump control apparatus for use with a heat pump system having an indoor heat exchanger, outdoor heat exchanger, compressor, and flow control means to direct a flow of refrigerant through said indoor and outdoor heat exchangers, said heat pump control apparatus comprising:

first temperature sensor means for monitoring ambient temperature in proximity to an outdoor heat exchanger coil and second temperature sensor means for monitoring outdoor heat exchanger coil temperature;

storage means for storing an adjustable enable temperature to adjust defrosting of said system;

processor means to compare the temperature of the heat exchange coil with the adjustable enable temperature and to set a status indicator if the heat exchanger coil temperature is less than the enable temperature; and defrost control means to defrost the heat exchange coil;

said processor means having timing means to monitor the status indicator and activate the defrost control means after the status indicator has been set for a predetermined compressor run period related to ambient temperature and further having means for sensing a failure in said first temperature sensor means and means for adjusting the predetermined compressor run period to a constant independent of ambient temperature in the event of such a failure.

21. The heat pump control apparatus of claim 20 wherein the processor means includes means for sensing a failure in said second temperature sensor and suspending controlled defrosting in the event of such a failure in the second temperature sensor.

22. A heat pump defrosting control apparatus for use with a heat pump unit having an indoor heat exchanger, an outdoor heat exchanger and a compressor operable to circulate refrigerant through said heat exchangers, the apparatus comprising:

(a) a first temperature sensor for detecting the temperature of atmospheric air and producing an output signal which varies according to variations in sensed atmospheric air temperature;

(b) a second temperature sensor for detecting the temperature of the outdoor heat exchanger and producing an output signal which varies according to sensed heat exchanger temperature;

(c) first defrost cycle enabling means for producing a defrost enabling condition in response to sensed atmospheric air temperature below a predetermined value;

(d) second defrost cycle enabling means for producing a second defrost enabling condition in response to accumulated compressor running time comprising:

(i) timer means for accumulating the running time of said compressor;

(ii) adjustment means for increasing and decreasing the extent of a lockout period during which a defrost cycle can not occur in response to sensed decreases and increases, respectively, of the ambient air temperature occurring during the lockout period; and (iii) means for enabling initiation of a defrost cycle in response to the aggregated compressor run time exceeding the most recently established lockout time period;

(e) third defrost cycle enabling means for producing a third defrost enabling condition in response to an indication of frost or ice on the outdoor heat exchanger comprising (i) first processing means for determining the difference between the sensed atmospheric air temperature and the sensed outdoor heat exchanger temperature; and (ii) second processing means for enabling initiation of a defrost cycle when the sensed temperature difference bears a predetermined relationship to the sensed outdoor air temperature, and (f) defrost means for initiating a defrost cycle in response to the said coexistence of the first, second, and third enabling conditions.

* * * * *

UNITED STATES PATENT AND TRADEMARK OFFICE

CERTIFICATE OF CORRECTION

PATENT NO. : 4,882,908 .

DATED : November 28, 1989

INVENTOR(S) : Lee A. White

It is certified that error appears in the above-identified patent and that said Letters Patent is hereby corrected as shown below:

Column 11, line 37, insert:

LISTING 1

WAIT FOR BELOW ENABLE TEMP

```
While  ( coil temp is above the enable temp    ) and
       ( no test in progress )

   measure coil temp at one minute intervals;
   measure ambient temp from time to time;
   if  coil sensor is fine
     then
       if  ambient sensor is fine also
         then
           check the below enable temp condition;
       end of if;
   end of if;
 end of while loop;

 if  a test is in effect
   then
     goto defrost cycle;
 end of if;
```

UNITED STATES PATENT AND TRADEMARK OFFICE

CERTIFICATE OF CORRECTION

PATENT NO. : 4,882,908
DATED : November 28, 1989
INVENTOR(S) : Lee A. White

It is certified that error appears in the above-identified patent and that said Letters Patent is hereby corrected as shown below:

Column 12, line 20, insert:

LISTING 2

WAIT FOR THE LOCKOUT TIME

```
turn on the lockout timer;

while  ( lockout condition not accomplished  )    and
       ( coil temp below enable temp )            and
       ( no test is in progress  )

 measure coil temp at one minute intervals;
 measure ambient temp from time to time;
 if  coil sensor is fine
   then
     check the lockout condition;

 if  ambient sensor is fine
   then
     check the below enable temp condition;
     if  coil temp is higher than enable temp
       then
         turn off the run timer;
      end of if;
   end of if;
 end of while loop
```

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

```
if  a test is in effect
  then
    go to defrost cycle;
end of if;

if  coil temp is above enable temp
  then
    go to wait state 116;
end of if;

if  ambient sensor has malfunctioned
  then
    go to defrost cycle;
end of if;
```

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

Column 12, line 57, insert:

TABLE 1

| Ambient (deg F) | Lockout time (mins) |
|---|---|
| 34 | 40.0 |
| 33 | 41 |
| 32 | 42 |
| 31 | 43 |
| 30 | 44 |
| 29 | 45 |
| 28 | 47 |
| 27 | 49 |
| 26 | 52 |
| 25 | 56 |
| 24 | 61 |
| 23 | 67 |
| 22 | 74 |
| 21 | 85 |
| 20 | 98 |
| 19 | 120 |

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

Column 13, line 34, insert:

LISTING 3

WAIT FOR FROST CONDITION

```
while  ( delta t condition is not good )     and
       ( no 6 hr override in effect )        and
       ( no test is in progress )            and
       ( ambient sensor is fine )

 measure coil temp at one minute intervals;
 if coil sensor is fine
   then
     check the below enable temp condition;
     if ( coil temp is above enable temp ) and
        ( the compressor is on )
       then
         check the delta t condition;
      end of if;
   end of if;
end of while loop;

if a test is in progress
  then
    go to defrost cycle;
end of if;

if  ambient sensor has malfunctioned
  then
    reset the lockout time status;
    go to wait for 90 minute cycle time;
end of if;
```

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

Column 13, line 42, insert:

LISTING 4

DEFROST CYCLE

```
if  a test is in progress
  then
    set transient, below enable temp, lockout, and
    delta t  status flags;
    set test-on, defrost-on status flags;
    reset coil and ambient sensor failure status flags;
end of if;

turn on defrost triac and strip heaters (if implemented);
turn on the defrost timer;

enable the coil sensor only;
get the termination temp index from RAM;
output the termination value to temperature ports;
 (R50-R53, R60-R63)
wait for 100 mini seconds;
```

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

```
 while  ( termination flag is not set )
  if A/D output (comparator 40) is low
    then
      wait for 200 mini seconds;
      /* to avoid being affected by */
      /* electrical noises          */
      if A/D output is still low
        then
          if  a test is in progress
            then
              maintain defrosting for at least 30 seconds;
          end of if;
        else
          turn off defrost triac;
          set the termination flag;
      end of if;
   end of if;
end of while loop;

  if  defrost time is more than 15 minutes
     then
       set the termination flag;
   end of if;

end of while loop;
```

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

Column 14, line 13, insert:

TABLE II

DEMAND DEFROST - PARAMETER TABLE

| (Optional) diode configuration | enable temp | Termination temp | C1 | C2 | strip heater |
|---|---|---|---|---|---|
| 1 | 24 | 35 | 0.10 | 1.0 | 15 |
| 2 | 25 | 40 | 0.15 | 2.0 | 16 |
| 3 | 26 | 45 | 0.20 | 3.0 | 17 |
| 4 | 27 | 50 | 0.25 | 4.0 | 18 |
| 5 | 28 | 55 | 0.30 | 5.0 | 19 |
| 6 | 29 | 60 | 0.35 | 6.0 | 20 |
| 7 | 30 | 65 | 0.40 | 7.0 | 21 |
| 8 | 31 | 70 | 0.45 | 8.0 | 22 |
| 9 | 32 | 75 | 0.50 | 9.0 | 23 |
| 10 | 33 | 80 | 0.55 | 10.0 | 24 |
| 11 | 34 | 85 | 0.60 | 11.0 | 25 |
| 12 | 35 | 90 | 0.65 | 12.0 | 26 |
| 13 | 36 | 95 | 0.70 | 13.0 | 27 |
| 14 | 37 | 100 | 0.75 | 14.0 | 28 |
| 15 | 38 | 105 | 0.80 | 15.0 | 29 |
| 16 | 39 | 110 | 0.85 | 16.0 | 30 |

UNITED STATES PATENT AND TRADEMARK OFFICE

CERTIFICATE OF CORRECTION

PATENT NO. : 4,882,908

DATED : November 28, 1989

INVENTOR(S) : Lee A. White

It is certified that error appears in the above-identified patent and that said Letters Patent is hereby corrected as shown below:

| | | | | | |
|---|---|---|---|---|---|
| 16 | 39 | 110 | 0.85 | 16.0 | 30 |

Signed and Sealed this

Twenty-eighth Day of July, 1992

*Attest:*

DOUGLAS B. COMER

*Attesting Officer*

*Acting Commissioner of Patents and Trademarks*